US009532138B1

(12) United States Patent
Allen

(10) Patent No.: US 9,532,138 B1
(45) Date of Patent: Dec. 27, 2016

(54) SYSTEMS AND METHODS FOR SUPPRESSING AUDIO NOISE IN A COMMUNICATION SYSTEM

(71) Applicant: Cirrus Logic, Inc., Austin, TX (US)

(72) Inventor: Justin Lamar Allen, Mesa, AZ (US)

(73) Assignee: Cirrus Logic, Inc., Austin, TX (US)

( * ) Notice: Subject to any disclaimer, the term of this patent is extended or adjusted under 35 U.S.C. 154(b) by 215 days.

(21) Appl. No.: 14/333,142

(22) Filed: Jul. 16, 2014

Related U.S. Application Data

(60) Provisional application No. 61/900,041, filed on Nov. 5, 2013.

(51) Int. Cl.
*H04R 3/00* (2006.01)

(52) U.S. Cl.
CPC ..... *H04R 3/002* (2013.01)

(58) Field of Classification Search
CPC ..... H04R 3/005; H04R 1/406; H04R 1/326; H04R 25/407
USPC ..... 381/92, 94.1, 122
See application file for complete search history.

(56) References Cited

U.S. PATENT DOCUMENTS 7,242,781 B2 * 7/2007 Hou ..... H04R 1/406 381/318
7,970,150 B2 6/2011 Oxford
8,565,446 B1 10/2013 Ebenezer
2008/0317259 A1 * 12/2008 Zhang ..... G10L 15/04 381/92
2009/0055170 A1 * 2/2009 Nagahama ..... G10L 15/20 704/226
2013/0190041 A1 7/2013 Andrews et al.

FOREIGN PATENT DOCUMENTS

WO 2011104655 A1 9/2011

* cited by examiner

*Primary Examiner* — David Ton
(74) *Attorney, Agent, or Firm* — Jackson Walker L.L.P.

(57) ABSTRACT

A method may include forming a plurality of beams to receive and spatially filter audible sounds from a first microphone and a second microphone. The plurality of beams may include a first unidirectional beam to receive audible sounds from the first microphone and the second microphone, a second unidirectional beam to receive audible sounds from the first microphone and the second microphone, the second unidirectional beam having a spatial null in a direction different from that of the first unidirectional beam, and an omnidirectional beam to receive audible sounds from the first microphone and the second microphone. The method may also include determining a first energy of audible sounds filtered by the first unidirectional beam and a second energy of audible sounds filtered by the second unidirectional beam and, based on the first energy and the second energy, selecting one of the plurality of beams as a selected beam.

32 Claims, 3 Drawing Sheets

SYSTEMS AND METHODS FOR SUPPRESSING AUDIO NOISE IN A COMMUNICATION SYSTEM

RELATED APPLICATIONS

The present disclosure claims priority to U.S. Provisional Patent Application Ser. No. 61/900,041, filed Nov. 5, 2013, which is incorporated by reference herein in its entirety.

FIELD OF DISCLOSURE

The present disclosure relates in general to circuits for audio devices, including without limitation multi-microphone speakerphones, teleconference phones, or other audio input devices, and more specifically, to systems and methods for suppressing audio noise incident upon microphones in such audio input devices.

BACKGROUND

This invention relates to audio signal processing and, in particular, to a circuit that estimates direction of arrival using plural microphones.

As used herein, "telephone" is a generic term for a communication device that utilizes, directly or indirectly, a dial tone from a licensed service provider. For the sake of simplicity, the invention is described in the context of a telephone but has broader utility; e.g., communication devices that do not utilize a dial tone, such as radio frequency transceivers or intercoms.

This present disclosure finds use in many applications where the internal electronics are essentially the same but the external appearance of the device is different. FIG. 1 illustrates a conference phone or speaker phone 10 such as found in business offices. Telephone 10 may include a plurality of microphones 11, 12, 13, and a speaker 15 in a sculptured case.

FIG. 2 illustrates what is sometimes referred to as a hands-free kit 20 for providing audio coupling to a cellular telephone (not shown). Hands-free kits come in a variety of implementations but generally include a case 16, a powered speaker 17 and a plug 18, which may couple to an accessory outlet or a cigarette lighter socket in a vehicle. Case 16 may contain more than one microphone or one of the microphones (not shown) may be separate and may plug into case 16. The external microphone may be for placement as close to a user as possible, e.g., clipped to a visor in a vehicle. Hands-free kit 20 may also include a cable for connection to a cellular telephone or have a wireless connection, such as a BLUETOOTH® interface, for example. A hands-free kit in the form of a head set may be powered by internal batteries but may be electrically similar to the apparatus illustrated in FIG. 2.

Communication with telephones, hands-free devices, and other communication systems are often attempted in noisy acoustical environments. For example, communications with a multi-microphone telephone (e.g., telephone 10) may be in a conference room or office with poor acoustics, with significant background noise. Hands-free kits (e.g., hands-free kit 20) may often be used in even more harsh acoustic environments, such as automobiles, airports, and restaurants.

As used herein, "noise" refers to any unwanted sound, whether or not the unwanted sound is periodic, purely random, or somewhere in between. As such, noise includes background music, voices (herein referred to as "babble") of people other than the desired speaker, tire noise, wind noise, etc.

Many digital signal processing techniques have been proposed for reducing noise. In products with a single microphone, reducing noise is quite difficult when the desired speech and the noise share the same frequency spectrum. It is difficult for these techniques to remove noise without damaging the desired speech. However, if the origin of the noise and the origin of the desired speech are spatially separated, then one can theoretically extract a clean speech signal from a noisy speech signal. One approach to spatially separating the origin of noise and the origin of desired speech is known as beam forming. Beam forming may be employed in a communication device having two or more microphones. With beam forming, one or more beams may be formed by a processing device (e.g., microprocessor, digital signal processor, etc.) of the communication device, wherein each beam acts as a spatial filter that passes acoustic energy from some spatial directions while filtering out acoustic energy from other directions. By forming a beam that points at or near a desired source of acoustic energy (e.g., a person who is speaking), the desired acoustic energy of the speaker may be passed by the spatial filter implemented by a beam while acoustic energy from noise sources or reflections of the desired source may be rejected or attenuated. In this manner, audio quality of the communication device may be improved.

Such improvement in audio quality may only be realized if the beam is pointed at or near the desired source (or alternatively, if the null of the beam is pointed at or near a noise source). However, this presents challenges in a speakerphone or video conference environment, as a location of desired source (e.g., a person talking) may not be known ahead of time and some method of desired source localization may be needed. This localization often takes the form of a "direction of arrival" estimation, wherein the angle of arrival of the desired acoustic energy (or the undesired noise) is estimated. In a speakerphone or videoconference environment, a desired source may move, or another desired source in a different spatial location may also exist (e.g., a second person begins speaking in another part of a room). Accordingly, desired sources must be tracked to maintain the beam pointing in a correct direction.

An existing approach to desired source location is cross-correlation. In cross-correlation, the delay between receipt of sounds at various microphones is calculated, and, because microphone geometry is typically known in advance, the direction of arrival may be determined based on such delay. However, cross-correlation may have many deficiencies. First, cross-correlation may be expensive, especially if there are more than two microphones, because a cross-correlation must be performed between each microphone and all other microphones, requiring significant processing resources. In addition, cross-correlation typically has significant latency, which impacts the rate at which a desired source can be tracked or the beam switched to another desired source. Furthermore, cross-correlation suffers from variation in spatial resolution, in that cross-correlation resolves desired source location when the desired source is about the same distance from each microphone, but as the desired source moves closer to one microphone, such resolution diminishes.

SUMMARY

In accordance with the teachings of the present disclosure, one or more disadvantages and/or problems associated with existing approaches to suppressing audio noise in a communication system may be reduced or eliminated.

In accordance with embodiments of the present disclosure, a noise suppression system may include a first microphone input, a second microphone input, a plurality of beam formers, and a beam selector. The first microphone input may be configured to receive a first microphone signal indicative of sounds incident upon a first microphone. The second microphone input may be configured to receive a first microphone signal indicative of sounds incident upon a second microphone. The plurality of beam formers may each be configured to form a respective one of a plurality of beams to receive and spatially filter audible sounds from the first microphone and the second microphone. The plurality of beam formers may include a first beam former, a second beam former, and a third beam former. The first beam former may be configured to form a first unidirectional beam to receive and spatially filter audible sounds from the first microphone and the second microphone. The second beam former may be configured to form a second unidirectional beam to receive and spatially filter audible sounds from the first microphone and the second microphone, the second unidirectional beam having a spatial null in a direction different from that of the first unidirectional beam. The third beam former may be configured to form an omnidirectional beam to receive and spatially filter audible sounds from the first microphone and the second microphone. The beam selector may be configured to determine a first energy of audible sounds filtered by the first unidirectional beam and a second energy of audible sounds filtered by the second unidirectional beam, and, based on at least the first energy and the second energy, select one of the plurality of beams as a selected beam.

In accordance with these and other embodiments of the present disclosure, a method may include forming a plurality of beams to receive and spatially filter audible sounds from a first microphone and a second microphone. The plurality of beams may include a first unidirectional beam to receive and spatially filter audible sounds from the first microphone and the second microphone, a second unidirectional beam to receive and spatially filter audible sounds from the first microphone and the second microphone, the second unidirectional beam having a spatial null in a direction different from that of the first unidirectional beam, and an omnidirectional beam to receive and spatially filter audible sounds from the first microphone and the second microphone. The method may also include determining a first energy of audible sounds filtered by the first unidirectional beam and a second energy of audible sounds filtered by the second unidirectional beam and, based on at least the first energy and the second energy, selecting one of the plurality of beams as a selected beam.

In accordance with embodiments of the present disclosure, a noise suppression system may include a first microphone input, a second microphone input, a plurality of beam formers, a beam selector, and a beam mixer subsystem. The first microphone input may be configured to receive a first microphone signal indicative of sounds incident upon a first microphone. The second microphone input may be configured to receive a first microphone signal indicative of sounds incident upon a second microphone. The plurality of beam formers may each be configured to form a respective one of a plurality of beams to receive and spatially filter audible sounds from the first microphone and the second microphone. The plurality of beam formers may include a first beam former and a second beam former. The first beam former may be configured to form a first unidirectional beam to receive and spatially filter audible sounds from the first microphone and the second microphone. The second beam former may be configured to form a second unidirectional beam to receive and spatially filter audible sounds from the first microphone and the second microphone, the second unidirectional beam having a spatial null in a direction different from that of the first unidirectional beam. The beam selector may be configured to determine a first energy of audible sounds filtered by the first unidirectional beam and a second energy of audible sounds filtered by the second unidirectional beam, and, based on at least the first energy and the second energy, select at least one of the plurality of beams as a selected beam. The beam mixer subsystem may be configured to mix selected beams to create an audio output signal.

In accordance with these and other embodiments of the present disclosure, a method may include forming a plurality of beams to receive and spatially filter audible sounds from a first microphone and a second microphone. The plurality of beams may include a first unidirectional beam to receive and spatially filter audible sounds from the first microphone and the second microphone and a second unidirectional beam to receive and spatially filter audible sounds from the first microphone and the second microphone, the second unidirectional beam having a spatial null in a direction different from that of the first unidirectional beam. The method may also include determining a first energy of audible sounds filtered by the first unidirectional beam and a second energy of audible sounds filtered by the second unidirectional beam and, based on at least the first energy and the second energy, selecting at least one of the plurality of beams as a selected beam. The method may further include when selection is switched from a first selected beam to a second selected beam, mixing selected beams to create an audio output signal.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
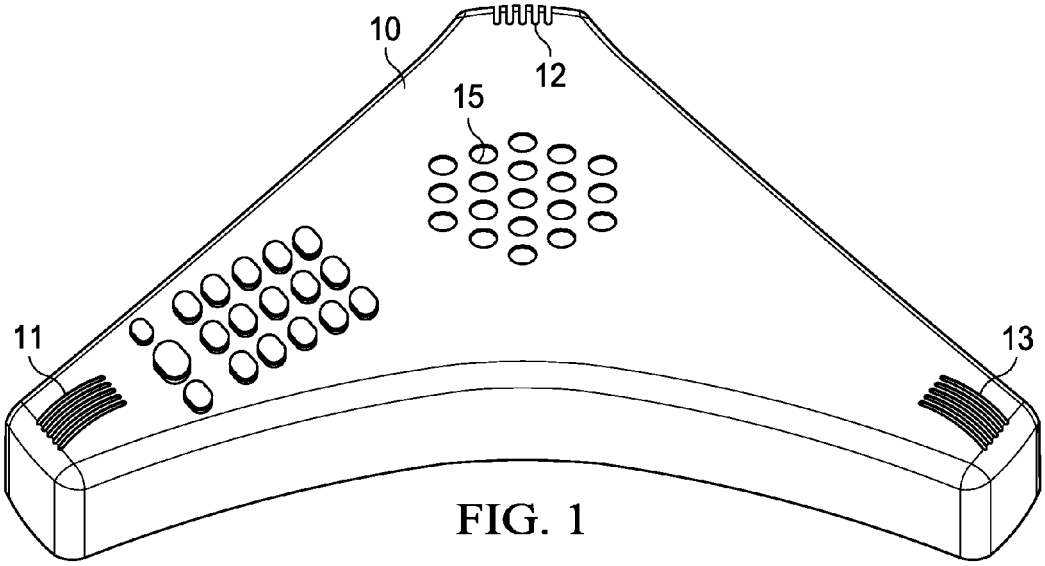
FIG. 1 is an illustration of an example communication device having a noise suppression system that may implement embodiments of the present disclosure.
Figure 2:
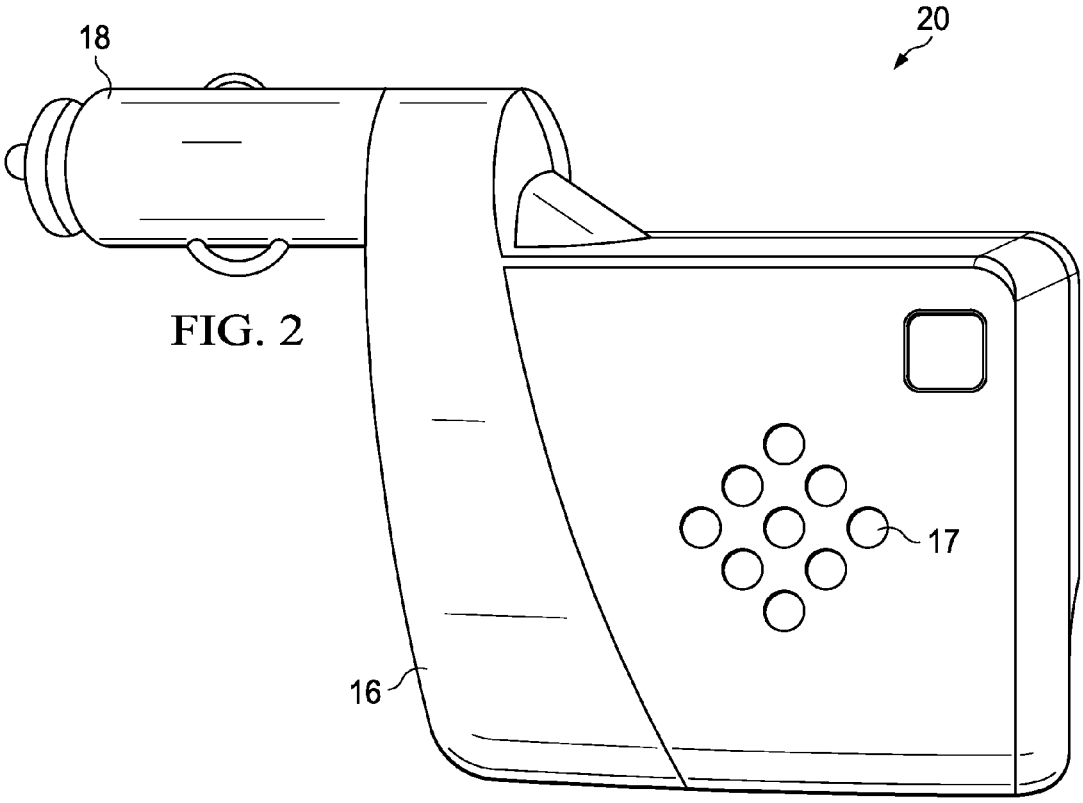
FIG. 2 is an illustration of an example hands-free kit having a noise suppression system that may implement embodiments of the present disclosure.
Figure 3A:
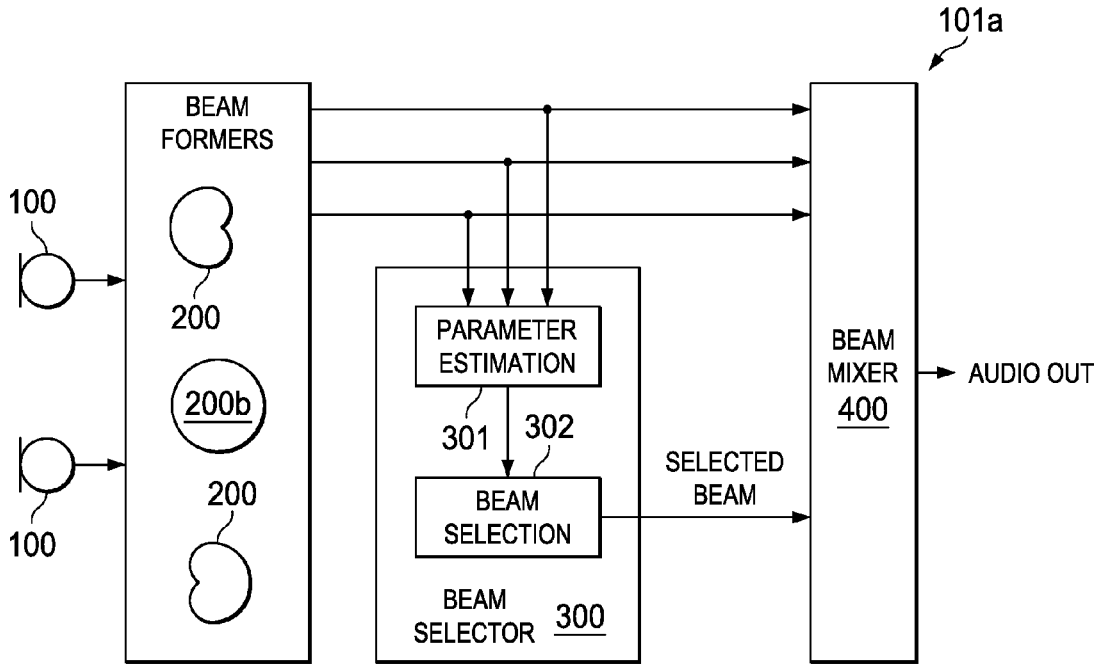
FIG. 3A is a block diagram of selected components of a noise suppression system comprising two microphone inputs, in accordance with embodiments of the present disclosure.
Figure 3B:
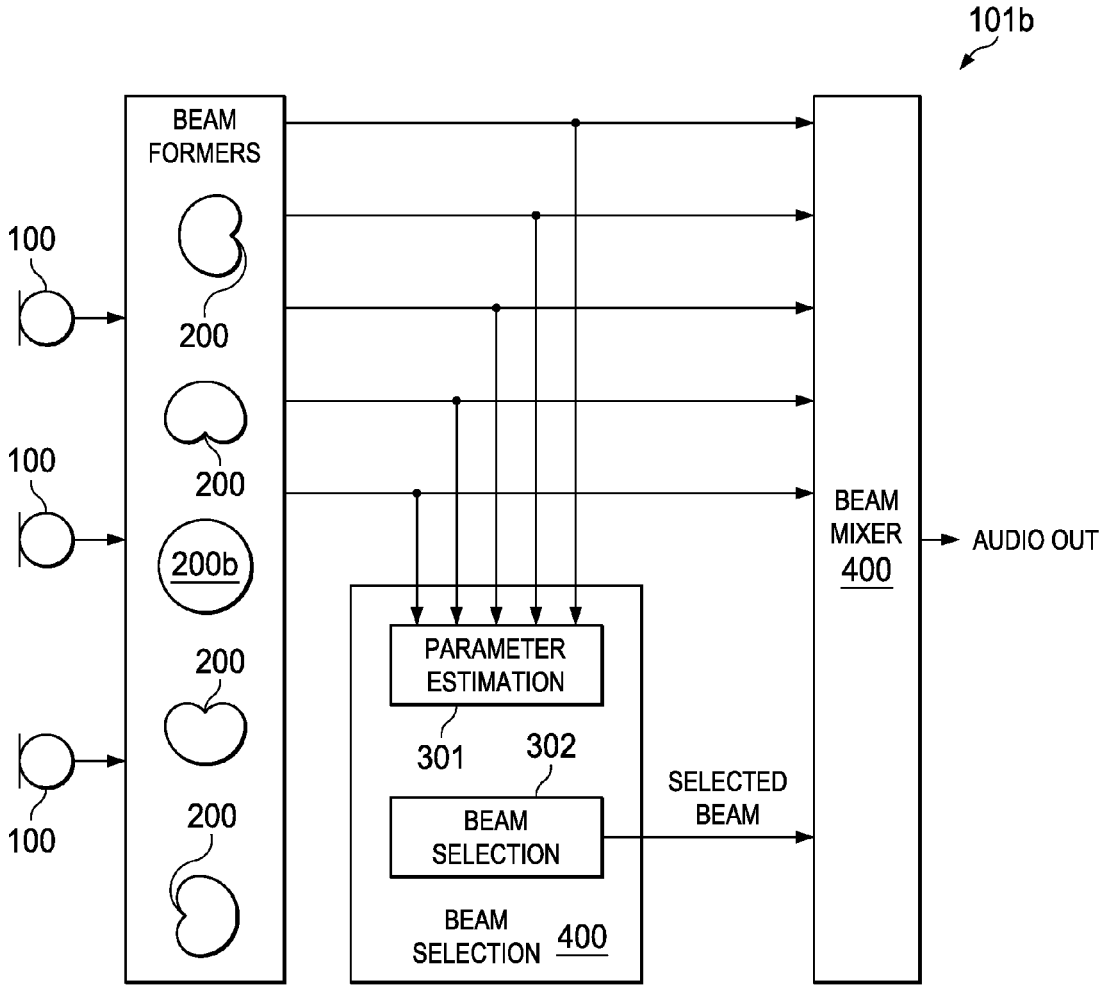
FIG. 3B is a block diagram of selected components of an example noise suppression system comprising three microphone inputs, in accordance with embodiments of the present disclosure.

FIG. 3A is a block diagram of selected components of a noise suppression system 101*a* comprising two microphone inputs, in accordance with embodiments of the present disclosure. FIG. 3B is a block diagram of selected components of a noise suppression system 101*b* comprising three microphone inputs, in accordance with embodiments of the present disclosure. Noise suppression systems 101*a* and 101*b* may individually be referred to herein as a noise suppression system 101 and collectively as noise suppression systems 101. Each noise suppression system 101 may be implemented within a communication device, including without limitation telephone 10 and/or hands-free kit 20 depicted in FIGS. 1 and 2, respectively. In some embodiments, one or more components of noise suppression systems 101 may be implemented in hardware. In these and other embodiments, one or more components of noise suppression systems 101 may be implemented in firmware, software, and/or other computer-readable instructions that may be executable by a processing device (e.g., a microprocessor, a digital signal processor, etc.).

As shown in FIGS. 3A and 3B, each noise suppression system 101 may include a plurality of microphones 100, a plurality of beam formers 200, a beam selector 300, and a beam mixer 400. A microphone 100 may comprise any system, device, or apparatus configured to convert sound incident upon such microphone 100 to an electrical signal, wherein such sound is converted to an electrical signal using a diaphragm or membrane having an electrical capacitance that varies as based on sonic vibrations received at the diaphragm or membrane. A microphone 100 may include an electrostatic microphone, a condenser microphone, an electret microphone, a microelectromechanical systems (MEMs) microphone, or any other suitable capacitive microphone. In some embodiments, microphones 100 may comprise matching (e.g., identical, of same model, etc.) omnidirectional microphones. Microphones 100 may be placed in any suitable location within a noise suppression system 101 and in any suitable location in a communication device (e.g., telephone 10, hands-free kit 20) to capture sounds in the vicinity of such communication device.

Beam formers 200 may comprise microphone inputs for receiving microphone signals generated by each of the plurality of microphones 100 and may generate a plurality of beams based on such microphone signals. Each of the plurality of beam formers 200 of a noise suppression system 101 may be configured to form a respective one of a plurality of beams to spatially filter audible sounds from the plurality of microphones 100. The plurality of beam formers 200 may include at least two unidirectional beam formers 200*a*. Each unidirectional beam former 200*a* may be configured to form a respective unidirectional beam to receive and spatially filter audible sounds from microphones 100, wherein such respective unidirectional beam has a spatial null in a direction different from that of all other unidirectional beams formed by other unidirectional beam formers 200*a*, such that the beams formed by unidirectional beam formers 200*a* all point in a different direction. In addition, in some embodiments, the plurality of beam formers 200 may include an omnidirectional beam former 200*b* configured to form an omnidirectional beam to receive and spatially filter audible sounds from the first microphone and the second microphone.

In some embodiments, beam formers 200 may be implemented as time-domain beam formers. The various beams formed by beam formers 200 may be formed at all times during operation. While FIG. 3A depicts unidirectional beam formers 200*a* of noise suppression system 101*a* forming two unidirectional beams from two microphones 100, it is noted that any suitable number of beams may be formed from such two microphones 100. In addition, while FIG. 3B depicts unidirectional beam formers 200*a* of noise suppression system 101*b* forming four unidirectional beams from three microphones 100, it is noted that any suitable number of beams (e.g., up to nine) may be formed from such three microphones 100. Furthermore, it is noted that a noise suppression system 101 in accordance with this disclosure may comprise any suitable number of microphones and any suitable number of unidirectional beam formers 200*a* configured to form unidirectional beams.

Beam selector 300 may include any suitable system, device, or apparatus configured to receive the simultaneously formed plurality of beams (or, at least the plurality of unidirectional beams) from beam formers 200, and, based on an analysis thereof, select which of the simultaneously-formed beams will be output as an audio output signal from a noise suppression system 101. As shown in FIGS. 3A and 3B, beam selector 300 may comprise a parameter estimation block 301 and a beam selection block 302.

Parameter estimation block 301 may comprise any system, device, or apparatus configured to estimate the acoustic energy present in each unidirectional beam formed by beam-formers 200*a*. In some embodiments, parameter estimation block 301 may estimate the acoustic energy in each unidirectional beam on a frame-by-frame basis, wherein each frame is a collection of samples (e.g., 32 or 64 samples) of an input signal. Frame processing may provide a way to more efficiently process samples, because they are processed in batches. In other embodiments, parameter estimation block 301 may estimate the acoustic energy in each unidirectional beam on a sample-by-sample basis. In such embodiments, digital samples of each frame of the output of each unidirectional beam may be squared and summed. Thus, a frame energy E[m] for a unidirectional beam may be given as:

$$E[m] = \sum_{n=0}^{N-1} x[n]^2$$

where x[n] is the nth sample of a frame and N is the number of samples in the frame. In some embodiments, the frame energy E[m] may be smoothed by an exponential averaging filter to generate a smoothed energy estimate $E_s$[m] for the frame given by the equation:

$$E_s[m]=rE_s[m-1]+(1-r)E[m]$$

where r is a constant weighting factor between 0 and 1.

Parameter estimation block 301 may output estimated acoustic energies for each unidirectional beam (e.g., frame energies, or smoothed frame energies) to beam selection block 302. Based on these estimated acoustic energies, beam selection block 302 may select one or more beams to be output as an audio output signal of the noise suppression system 101, and output a signal SELECTED BEAM indicating the one or more beams selected. In some embodiments, beam selection block 302 may select a unidirectional beam if a scaled energy associated with such unidirectional beam is greater than each of the estimated energies of the other unidirectional beams. A scaled energy for a unidirectional beam may be calculated by multiplying a tolerance factor by the estimated energy (e.g., frame energy, smoothed frame energy) for such unidirectional beam, wherein such tolerance factor is a constant between 0 and 1. In some embodiments, the tolerance factor may be the same for each unidirectional beam, while in other embodiments, the tolerance factors for each unidirectional beam may be different. In these and other embodiments, the tolerance factor for each unidirectional beam may be adjustable by a user of a noise suppression system 101. Thus, beam selection block 302 may apply the following algorithm in order to select a beam for the audio output signal:

if scaled energy of unidirectional beam 1>all un-scaled energies of other unidirectional beams, then select unidirectional beam 1;

else if scaled energy of unidirectional beam 2>all un-scaled energies of other unidirectional beams, then select unidirectional beam 2;

.

.

.

else if scaled energy of unidirectional beam K>all un-scaled energies of other unidirectional beams, then select unidirectional beam K; //where K=number of unidirectional beams else select the omnidirectional beam Thus, using such algorithm, or an algorithm similar thereto, beam selection block 302 may attempt to identify a dominant unidirectional beam with an energy much greater than the other unidirectional beams, and if such a dominant beam is identified, the dominant beam may be selected. Otherwise, if no dominant beam is found, the omnidirectional beam may be selected.

In the algorithm for beam selection described above, an omnidirectional beam is used as a default beam in the event no dominant unidirectional beam is identified. However, in other embodiments, instead of having a default beam, each beam may be mixed in some proportion to create an audio output signal. In such embodiments, each beam would be configured to detect voice activity on such beam, and if voice activity is detected on a unidirectional beam, then the unidirectional beam may be mixed into the output signal. The proportion of such mixing (e.g., the gain applied to mix each unidirectional beam) might be varied depending on the detected volume of speech or some other criteria. For example, in some embodiments, all of the energy levels of audio sources may be normalized such that they might have the same volume at a communication device to which the captured sound is transmitted.

Immediately switching an audio output of a noise suppression system 101 from one beam to another may lead to audio artifacts (e.g., "pops" and "clicks" which may be noticeable by a listener receiving the audio output of the noise suppression system 101). Accordingly, measures to reduce such artifacts may be desirable.

Figure 4:
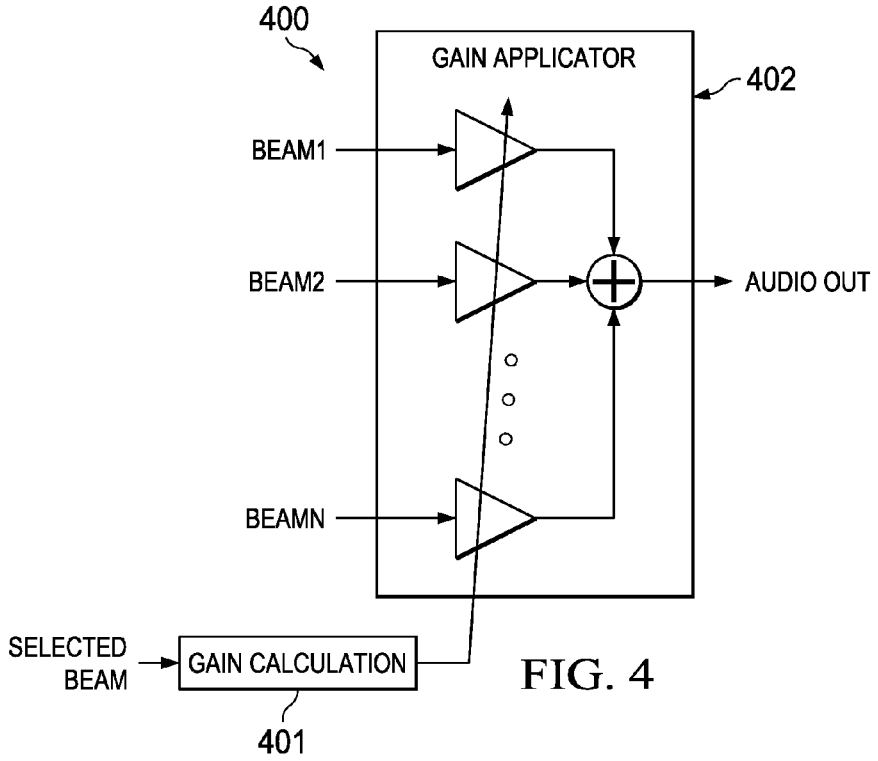
FIG. 4 is a block diagram of selected components of an example beam mixer, in accordance with embodiments of the present disclosure.

FIG. 4 is a block diagram of selected components of a beam mixer 400, in accordance with embodiments of the present disclosure. Beam mixer 400 may be any suitable system, device, or apparatus configured to receive outputs of the beams formed by beam formers 200 and mix such outputs to eliminate or reduce audio artifacts that may occur when switching selection between beams. For example, when beam selector 300 switches selection between two beams, beam mixer 400 may cross-fade the audio output signal AUDIO OUT between the outputs of the two beams. In some embodiments, the rate of cross-fade may be programmable. In these and other embodiments, beam mixer 400 may also be configured to reduce or eliminate audio artifacts in the event that beam selection changes during a cross-fade from one beam to another.

As shown in FIG. 4, beam mixer 400 may comprise a gain calculation block 401 and a gain applicator 402. Gain calculation block 401 may calculate a gain for each beam of a current digital sample of the beams. Gain applicator 402 may then apply the gain for each beam to its respective output, and sum the gained outputs. During any sample, the gains for each beam may sum to 1, such that beam mixer 400 is a unity-gain block. In operation, beam mixer 400, may, in each sample, compare the value of a current gain for each beam to a value of a desired gain of each beam. A desired gain for a selected beam may equal 1 while a desired gain for other beams may be 0. At each sample, the gain may be stepped from its current value toward its desired value in accordance with a step size, which may be calculated as:

$$\text{Step Size}=1/(F_s\times\text{RampTime})$$

where $F_s$ is a sampling frequency of the noise suppression system 101 and RampTime is a time in seconds which it takes to ramp a signal gain from 0 to 1.

In each sample, the gain of the selected beam may be increased by the value Step Size, to a maximum of 1, while the gain of the other beams may be decreased by the value StepSize, to a minimum of 0. At each sample, after the gains for each beam have been updated, they may be applied to each beam, and the beams summed to generate the audio output signal AUDIO OUT.

In alternative embodiments of beam mixer 400, beams may have different maximum gains for each beam depending on a beam type. For example, a beam lacking a null (e.g., an omnidirectional beam) may have a lower maximum gain than a beam with a null (e.g., a unidirectional beam), as the beam without a null receives more energy.

The methods and systems disclosed herein may be an improvement over known approaches for noise suppression, as the methods and systems may provide for noise suppression in a communication device using a small number of microphones (e.g., 2 or 3), and such microphones can be implemented using omnidirectional microphones, which may be more cost-effective than directional microphones. The methods and systems disclosed herein may also provide for noise suppression in an efficient manner requiring relatively low processing and memory resources. The approaches disclosed herein may have low latency, may be able to switch between desired audio sources in a short amount of time, and may have the same spatial resolution at all angles.

This disclosure encompasses all changes, substitutions, variations, alterations, and modifications to the exemplary embodiments herein that a person having ordinary skill in the art would comprehend. Similarly, where appropriate, the appended claims encompass all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A noise suppression system comprising:

a first microphone input configured to receive a first microphone signal indicative of sounds incident upon a first microphone;

a second microphone input configured to receive a second microphone signal indicative of sounds incident upon a second microphone;

a plurality of beam formers each configured to form a respective one of a plurality of beams to spatially filter audible sounds from the first microphone and the second microphone, the plurality of beam formers comprising:

a first beam former configured to form a first unidirectional beam to receive and spatially filter audible sounds from the first microphone and the second microphone;

a second beam former configured to form a second unidirectional beam to receive and spatially filter audible sounds from the first microphone and the second microphone, the second unidirectional beam having a spatial null in a direction different from that of the first unidirectional beam; and a third beam former configured to form an omnidirectional beam to receive and spatially filter audible sounds from the first microphone and the second microphone; and a beam selector configured to:

determine a first energy of audible sounds filtered by the first unidirectional beam and a second energy of audible sounds filtered by the second unidirectional beam; and based on at least the first energy and the second energy, select one of the plurality of beams as a selected beam to be output as an output signal of the noise suppression system.

2. The noise suppression system of claim 1, wherein:

the plurality of beam formers includes one or more additional beam formers each configured to form a respective additional unidirectional beam to receive and spatially filter audible sounds from the first microphone and the second microphone, wherein each additional unidirectional beam has a spatial null in a direction different from that of the first unidirectional beam, the second unidirectional beam, and the other additional unidirectional beams; and the beam selector is further configured to:

determine, for each additional unidirectional beam, an additional energy of audible sounds filtered by such additional unidirectional beam;

based on the first energy, the second energy, and the additional energies, select one of the plurality of beams as the selected beam.

3. The noise suppression system of claim 2, further comprising a third microphone, wherein the first unidirectional beam, the second unidirectional beam, and the one or more additional unidirectional beams are further configured to receive and spatially filter audible sounds from the third microphone.

4. The noise suppression system of claim 2, wherein the beam selector is further configured to:

compare a scaled first energy to the second energy and the additional energies, wherein the scaled first energy is equal to the first energy multiplied by a first tolerance factor between 0 and 1;

compare a scaled second energy to the first energy and the additional energies, wherein the scaled second energy is equal to the second energy multiplied by a second tolerance factor between 0 and 1;

for each additional unidirectional beam, compare a respective scaled additional energy to the first energy, the second energy, and the other additional energies, wherein each scaled additional energy is equal to its respective additional energy multiplied by a respective additional tolerance factor between 0 and 1;

select the first unidirectional beam as the selected beam if the scaled first energy is greater than the second energy and the additional energies;

select the second unidirectional beam as the selected beam if the scaled second energy is greater than the first energy and the additional energies;

select one of the additional unidirectional beams as the selected beam if the respective scaled additional energy for such additional unidirectional beam is greater than the first energy, the second energy, and the other additional energies; and if none of the first directional beam, the second directional beam, and the additional directional beams are selected as the selected beam, select the omnidirectional beam as the selected beam.

5. The noise suppression system of claim 4, wherein the first tolerance factor, the second tolerance factor, and each additional tolerance factor have the same value.

6. The noise suppression system of claim 4, wherein at least one of the first tolerance factor, the second tolerance factor, and each additional tolerance factor are adjustable by a user of the noise suppression system.

7. The noise suppression system of claim 1, wherein the beam selector is further configured to:

compare the first energy to the second energy; and select one of the plurality of beams as the selected beam based on the comparison.

8. The noise suppression system of claim 1, wherein the beam selector is further configured to:

compare a scaled first energy to the second energy, wherein the scaled first energy is equal to the first energy multiplied by a first tolerance factor between 0 and 1;

compare a scaled second energy to the first energy, wherein the scaled second energy is equal to the second energy multiplied by a second tolerance factor between 0 and 1;

select the first unidirectional beam as the selected beam if the scaled first energy is greater than the second energy;

select the second unidirectional beam as the selected beam if the scaled second energy is greater than the first energy; and select the omnidirectional beam as the selected beam if the scaled second energy is lesser than the first energy and the scaled first energy is lesser than the second energy.

9. The noise suppression system of claim 8, wherein the first tolerance factor and the second tolerance factor have the same value.

10. The noise suppression system of claim 8, wherein at least one of the first tolerance factor and the second tolerance factor are adjustable by a user of the noise suppression system.

11. The noise suppression system of claim 10, further comprising a beam mixer subsystem, the beam mixer subsystem configured to, when the beam selector switches selection from a first selected beam to a second selected beam, cross-fade the audio output signal between the first selected beam and the second selected beam.

12. The noise suppression system of claim 1, wherein the audible sounds captured by the selected beam are output to a processing circuit as an audio output signal.

13. A method comprising:

forming a plurality of beams to capture audible sounds from a first microphone and a second microphone, the plurality of beams comprising:

a first unidirectional beam to receive and spatially filter audible sounds from the first microphone and the second microphone;

a second unidirectional beam to receive and spatially filter audible sounds from the first microphone and the second microphone, the second unidirectional beam having a spatial null in a direction different from that of the first unidirectional beam; and an omnidirectional beam to receive and spatially filter audible sounds from the first microphone and the second microphone; and determining a first energy of audible sounds filtered by the first unidirectional beam and a second energy of audible sounds filtered by the second unidirectional beam; and based on at least the first energy and the second energy, selecting one of the plurality of beams as a selected beam select one of the plurality of beams as a selected beam to be output as an output signal.

14. The method of claim 13, further comprising:

forming one or more additional unidirectional beams to receive and spatially filter audible sounds from the first microphone and the second microphone, wherein each additional unidirectional beam has a spatial null in a direction different from that of the first unidirectional beam, the second unidirectional beam, and the other additional unidirectional beams;

determining, for each additional unidirectional beam, an additional energy of audible sounds filtered by such additional unidirectional beam; and based on the first energy, the second energy, and the additional energies, selecting one of the plurality of beams as the selected beam.

15. The method of claim 14, wherein the first unidirectional beam, the second unidirectional beam, and the one or more additional unidirectional beams are further configured to receive and spatially filter audible sounds from a third microphone.

16. The method of claim 14, further comprising:

comparing a scaled first energy to the second energy and the additional energies, wherein the scaled first energy is equal to the first energy multiplied by a first tolerance factor between 0 and 1;

comparing a scaled second energy to the first energy and the additional energies, wherein the scaled second energy is equal to the second energy multiplied by a second tolerance factor between 0 and 1;

for each additional unidirectional beam, comparing a respective scaled additional energy to the first energy, the second energy, and the other additional energies, wherein each scaled additional energy is equal to its respective additional energy multiplied by a respective additional tolerance factor between 0 and 1;

selecting the first unidirectional beam as the selected beam if the scaled first energy is greater than the second energy and the additional energies;

selecting the second unidirectional beam as the selected beam if the scaled second energy is greater than the first energy and the additional energies;

selecting one of the additional unidirectional beams as the selected beam if the respective scaled additional energy for such additional unidirectional beam is greater than the first energy, the second energy, and the other additional energies; and if none of the first directional beam, the second directional beam, and the additional directional beams are selected as the selected beam, selecting the omnidirectional beam as the selected beam.

17. The method of claim 16, wherein the first tolerance factor, the second tolerance factor, and each additional tolerance factor have the same value.

18. The method of claim 16, wherein at least one of the first tolerance factor, the second tolerance factor, and each additional tolerance factor are adjustable by a user of a noise suppression system associated with the first microphone and the second microphone.

19. The method of claim 13, further comprising:

comparing the first energy to the second energy; and selecting one of the plurality of beams as the selected beam based on the comparison.

20. The method of claim 13, further comprising:

comparing a scaled first energy to the second energy, wherein the scaled first energy is equal to the first energy multiplied by a first tolerance factor between 0 and 1;

comparing a scaled second energy to the first energy, wherein the scaled second energy is equal to the second energy multiplied by a second tolerance factor between 0 and 1;

selecting the first unidirectional beam as the selected beam if the scaled first energy is greater than the second energy;

selecting the second unidirectional beam as the selected beam if the scaled second energy is greater than the first energy; and selecting the omnidirectional beam as the selected beam if the scaled second energy is lesser than the first energy and the scaled first energy is lesser than the second energy.

21. The method of claim 20, wherein the first tolerance factor and the second tolerance factor have the same value.

22. The method of claim 20, wherein at least one of the first tolerance factor and the second tolerance factor are adjustable by a user of the noise suppression system.

23. The method of claim 22, further comprising, when selection is switched from a first selected beam to a second selected beam, cross-fading the audio output signal between the first selected beam and the second selected beam.

24. The method of claim 13, wherein the audible sounds captured by the selected beam are output to a processing circuit as an audio output signal.

25. A noise suppression system comprising:

a first microphone input configured to receive a first microphone signal indicative of sounds incident upon a first microphone;

a second microphone input configured to receive a first microphone signal indicative of sounds incident upon a second microphone;

a plurality of beam formers each configured to form a respective one of a plurality of beams to receive and spatially filter audible sounds from the first microphone and the second microphone, the plurality of beam formers comprising:

a first beam former configured to form a first unidirectional beam to receive and spatially filter audible sounds from the first microphone and the second microphone; and a second beam former configured to form a second unidirectional beam to receive and spatially filter audible sounds from the first microphone and the second microphone, the second unidirectional beam having a spatial null in a direction different from that of the first unidirectional beam;

a beam selector configured to:

determine a first energy of audible sounds filtered by the first unidirectional beam and a second energy of audible sounds filtered by the second unidirectional beam; and based on at least the first energy and the second energy, select at least one of the plurality of beams as a selected beam; and a beam mixer subsystem configured to, mix selected beams to create an audio output signal.

26. The noise suppression system of claim 25, the beam mixer subsystem configured to, when the beam selector switches selection from a first selected beam to a second selected beam, cross-fade an audio output signal between the first selected beam and the second selected beam.

27. The noise suppression system of claim 25, wherein a proportion of mixing of the selected beams is based on one or more criteria.

28. The noise suppression system of claim 27, wherein the one or more criteria comprise a volume of speech received by each of the selected beams.

29. A method comprising:

forming a plurality of beams to receive and spatially filter audible sounds from a first microphone and a second microphone, the plurality of beams comprising:

a first unidirectional beam to receive and spatially filter audible sounds from the first microphone and the second microphone; and a second unidirectional beam to receive and spatially filter audible sounds from the first microphone and the second microphone, the second unidirectional beam having a spatial null in a direction different from that of the first unidirectional beam;

determining a first energy of audible sounds filtered by the first unidirectional beam and a second energy of audible sounds filtered by the second unidirectional beam;

based on at least the first energy and the second energy, selecting at least one of the plurality of beams as a selected beam; and mixing selected beams to create an audio output signal.

30. The method of claim 29, further comprising, when the beam selector switches selection from a first selected beam to a second selected beam, cross-fade an audio output signal between the first selected beam and the second selected beam.

31. The method of claim 29, wherein a proportion of mixing of the selected beams is based on one or more criteria.

32. The method of claim 31, wherein the one or more criteria comprise a volume of speech received by each of the selected beams.

* * * * *